United States Patent [19]

Malkin et al.

[11] Patent Number: 4,935,590

[45] Date of Patent: Jun. 19, 1990

[54] GAS-BLAST CIRCUIT BREAKER

[75] Inventors: Peter Malkin, St. Ismier; Raymond V. Bresson; Paul Glenat, both of Grenoble; Jean-Claude Faye, Seyssinet, all of France

[73] Assignee: Merlin Gerin, France

[21] Appl. No.: 309,145

[22] Filed: Feb. 13, 1989

[30] Foreign Application Priority Data

Mar. 1, 1988 [FR] France ..... 88 02676

[51] Int. Cl.[5] ..... H01H 33/88

[52] U.S. Cl. ..... 200/148 A; 200/148 R

[58] Field of Search ..... 200/148 A, 148 R

[56] References Cited

FOREIGN PATENT DOCUMENTS 1281528 10/1968 Fed. Rep. of Germany .
2342520 3/1975 Fed. Rep. of Germany .
2302581 9/1976 France .
320531 5/1957 Switzerland .

*Primary Examiner*—Robert S. Macon
*Attorney, Agent, or Firm*—Arnold, White & Durkee

[57] ABSTRACT

A puffer SF6 circuit breaker comprises a pair of separable contacts with formation of a breaking gap, a piston-cylinder assembly to compress the gas when the movable contact is actuated to the open position, and a puffer nozzle designed to channel the gas outflow to the breaking gap so as to cool the arc by forced convection. The nozzle is totally or partially made of transparent or translucent insulating material to allow a part of the energy to be removed by radiation.

9 Claims, 2 Drawing Sheets

GAS-BLAST CIRCUIT BREAKER

BACKGROUND OF THE INVENTION

The invention relates to a gas-blast electrical circuit breaker comprising:

a sealed casing filled with high dielectric strength insulating gas, notably sulphur hexafluoride, a pair of separable contacts having a stationary or semi-stationary contact and a movable contact designed to be moved by an operating means between a closed position and an open position, a breaking gap with formation of an arc between the separated contacts, and a gas-blast device capable of generating a gas outflow to the breaking gap to cool the arc by convection.

In state-of-the-art SF6 piston compression circuit breakers, cooling of the arc before zero current is performed by convection by replacing a certain quantity of hot gas with cold gas. In the vicinity of zero current, cooling of the arc is achieved mainly by radial conduction. It can be noted that convection and conduction are the two main heat exchange modes. The heat exchange by radiation is very low during breaking of a low intensity arcing current. During the high arcing current period, the heat exchange by radiation becomes great, and subjects the puffer nozzle to high heat stresses. The opaque nozzle is generally made of polytetrafluorethylene loaded with alumina. Manufacturing of a nozzle of this kind is achieved by machining.

The object of the invention consists in improving the breaking performances of an SF6 gas-blast circuit breaker.

SUMMARY OF THE INVENTION

The circuit breaker according to the invention is characterized in that the gas-blast device comprises an insulating arc confinement wall, made of a material transparent or translucent to radiation of the arc. The transparency of the arc confinement wall makes it possible to remove a part of the energy of the arc by radiation. This results in a decrease of the heat action of the arc on the wall, and high-speed extinguishing of the arc. The transparent material of the wall is formed by a mineral or plastic compatible with SF6 gas.

According to a first embodiment, the gas-blast circuit breaker is of the puffer type by means of a piston-cylinder assembly, and the puffer nozzle constitutes said arc confinement wall which channels the gas outflow to the breaking gap. The nozzle totally or partially made of a material transparent to radiation of the arc.

According to a second embodiment, the gas-blast circuit breaker is of the gas expansion type with or without arc rotation, and the enclosure in which the gas pressure increases due to the action of the arc has a transparent wall allowing part of the energy of the arc to pass through by radiation.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
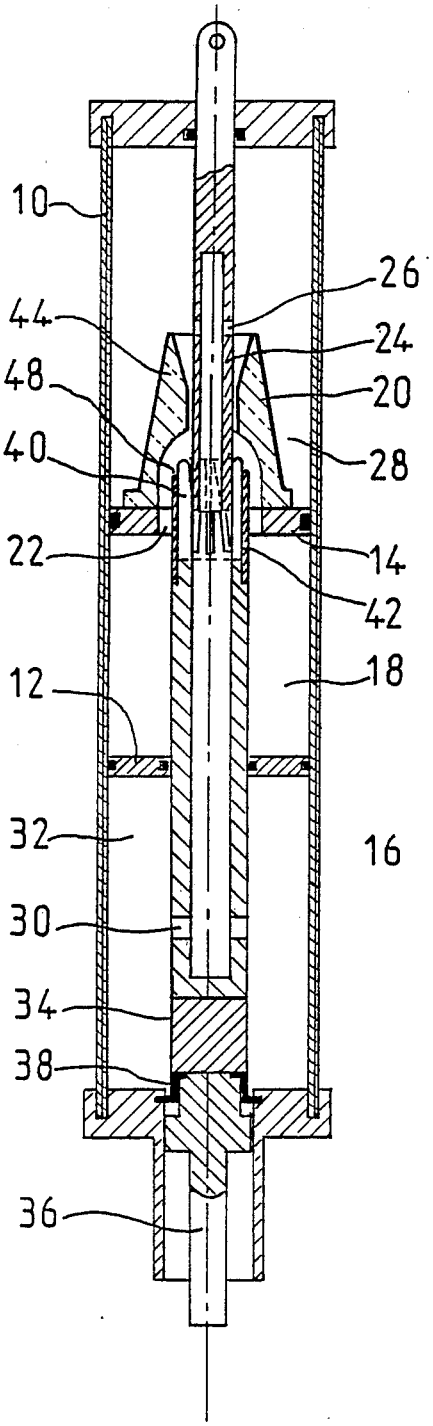
FIG. 1 is an axial sectional view of a piston-compression puffer-type circuit breaker equipped with a nozzle according to the invention, the circuit breaker being represented in the closed position.
Figure 2:
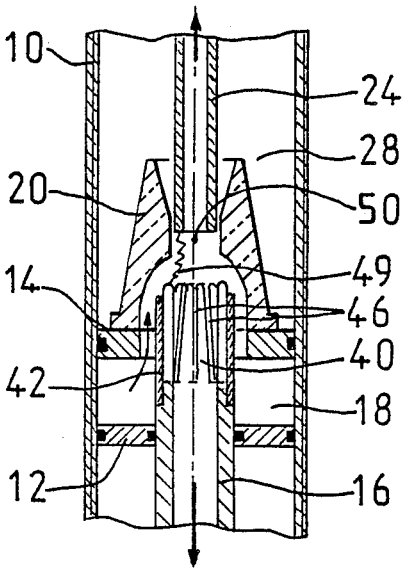
FIG. 2 is a partial view of FIG. 1, in the course of opening of the contacts during the arcing period.
Figure 3:
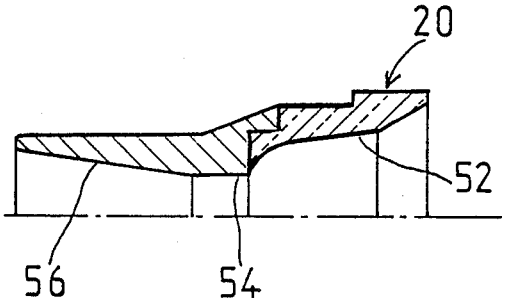
FIG. 3 shows a sectional half-view of an alternative embodiment of a puffer nozzle.

In FIGS. 1 and 2, the invention is applied to an electrical puffer circuit breaker or switch described in French Pat. No. 2,302,581 filed by the applicant. The circuit breaker can be used in a medium or high voltage supply system, and is housed in a cylindrical casing 10, filled with high dielectric strength insulating gas, notably sulphur hexafluoride. The elongated casing 10 is divided into two compartments by a fixed transverse partition 12. A puffer piston 14, securedly united to a hollow stationary contact 16, slides along a cylinder formed by the internal wall of the cylindrical casing 10 making the size of a compressable volume 18 comprised between the movable piston 14 and the partition 12 vary. The piston 14 is fitted with a puffer nozzle 20, having a convergent-divergent shape capable of guiding the gas outlet established via openings 22 provided in the piston 14. A hollow stationary contact 24 is axially aligned with the movable contact 16 and comprises orifices 26 providing communication between the inside of the hollow contact 24 and the arc extinguishing chamber. A second series of orifices 30 connects the internal volume of the hollow movable contact 16 to the downside compartment 32. A solid insulating part 34 insulates the operating rod 36 from the movable contact 16 and an elastomer membrane makes the compartment 32 leaktight.

The tulip-finger movable contact 16, fitted with flexible fingers 40, interlocks in the stationary contact 24 during the closing travel. The interlocking arrangement of the contacts 16, 24 causes precompression of the gas at the beginning of actuation of the circuit breaker rod 36 and before separation of the contacts 24, 16.

A tubular sheath 42 made of deformable plastic material, covers the interstices 46 arranged between the flexible fingers 40 of the movable contact 16. The terminal face 48 of the sheath 42 is disposed axially behind the transverse trace plane XX' passing through the free ends of the fingers 40.

The stationary contact 24 can cooperate with a spring to be semi-stationary.

According to the invention, the puffer nozzle 20 is totally or partially made from a material transparent to the radiations generated by the arc 49 in the breaking gap 50. The material used may be a translucent mineral insulator, notably ceramic or glass-based, or a transparent plastic insulator, for example a polycarbonate or a polymethylmethacrylate. Other translucent materials compatible with SF6 gas can naturally be used.

FIG. 2 shows a puffer nozzle made of composite material, having an opaque alumina-loaded polytetrafluorethylene convergent 52, the remainder comprising the neck 54 and the divergent 56 being made of translucent insulating material.

Operation of the puffer-type circuit breaker according to FIGS. 1 and 2 is as follows:

After the precompression phase in the course of which the SF6 gas is compressed by the downward movement of the piston 14 in the compressable volume 18, the contacts 16, 24 separate with formation of an axial arc 49. During the arcing period occurring before zero current, the heat energy developed by the arc is removed after gas compression causing an outflow of SF6 gas channeled by the nozzle 20 and guided through the hollow contacts 16, 24. This results in cooling of the arc by forced convection allowing a certain quantity of hot gas to be replaced by cold gas. In the vicinity of zero current, cooling of the arc is achieved by radial thermal conductivity. In addition to these two heat exchange modes by convection and conduction, a third heat exchange mode is implemented in the self-compression circuit breaker by radiation due mainly to the propagation of the luminous radiations of the arc through the translucent material of the puffer nozzle 20. A large part of the energy of the arc 49 is thus removed from the breaking gap 50 to the casing 10 outside the nozzle 20. This results in a decrease of the heat stresses of the arc 49 on the nozzle 20, and high-speed extinguishing of the arc. After successful breaking at zero current, the movable contact 16 continues its travel to the open position corresponding to the insulation level of the circuit breaker.

In the case of a translucent thermoplastic material, the puffer nozzle 20 is advantageously made by molding. A nozzle of this kind can also be used in the circuit breaker described in French Pat. No. 2,496,334.

Figure 4:
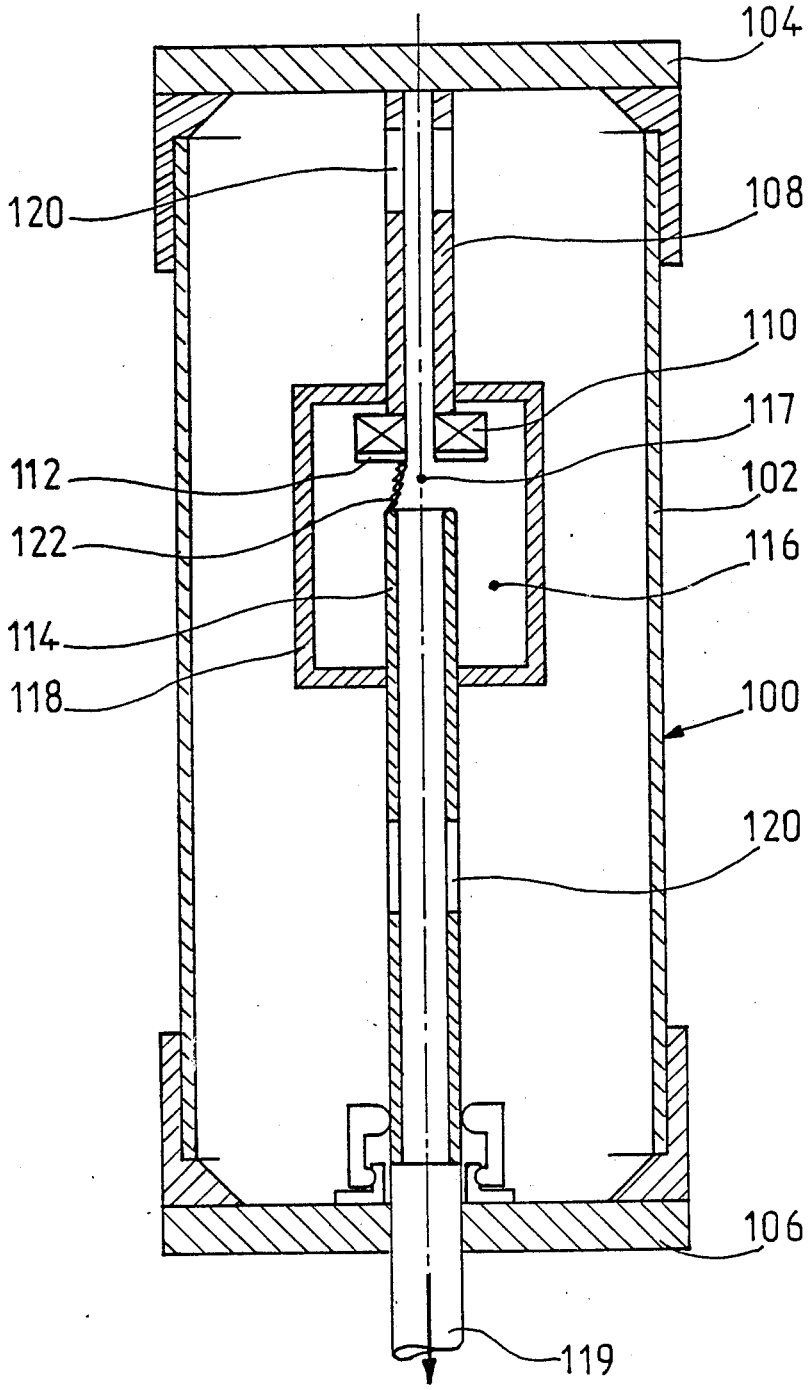
FIG. 4 represents an identical view to FIG. 1 of an alternative embodiment of the invention.

According to the alternative embodiment in FIG. 4, a pole of a self-expansion and rotating arc circuit breaker or switch comprises a sealed casing 100 filled with SF6 at atmospheric pressure. The casing 100 is formed by a cylindrical side wall 102 made of insulating material sealed at its ends by two end-plates 104, 106 made of conducting material constituting the current terminal strips. The upper end-plate 104 bears a hollow stationary contact 108 and coil 110 assembly associated with an arc rotation electrode 112. The tubular movable contact 114 extends in axial alignment with the stationary contact inside an extinguishing chamber 116 confined by an internal enclosure 118 made of translucent insulating material. The breaking gap 117 is located inside the chamber 116 and the movable contact 114 passes through the enclosure 118 with a preset clearance, and is mechanically coupled by the opposite end to an operating rod 119, passing through the lower end-plate 106. The rod 119 is of course insulated from the movable contact 114. The extinguishing chamber 116 communicates with the casing 100 by outlets constituted by the tubular contacts 108, 114 equipped with orifices 120. The arc 122 drawn in the extinguishing chamber 116 is made to rotate by the field of the coil 110, causing a heat rise and increased pressure of the SF6 gas, which then escapes via the outlets of the contacts 108, 114 to an expansion chamber formed by the internal volume of the casing 100. Pneumatic blowing by self-expansion causes cooling of the arc by convection. Extinguishing the arc is facilitated by the radiation effect due to partial removal of the energy of the arc through the wall of the translucent enclosure 118. The luminous radiations emitted by the arc from the extinguishing chamber 116 remain enclosed inside the casing 100.

It can be noted that the combination of the two self-expansion and arc rotation effects is completed by the physical effect of radiation through the wall of the extinguishing chamber 16.

The enclosure 118 may be of any shape, for example cylindrical, spherical or ellipsoidal. The coil 110 can be replaced by a permanent magnet.

In the case of a self-expansion circuit breaker having main contacts and arcing contacts, the enclosure 118 can also be metallic and comprise an opening blanked off by a transparent shield at the level of the breaking gap 117.

The shape of the translucent revolution enclosure 118 according to FIG. 4 may be dissymmetric to constitute a convergent or divergent optic lens designed to increase the radiation effect of the arc.

The invention can be applied to any other type of switch or circuit breaker with arc cooling by convection having at least one arc confinement wall, made of transparent material.

What is claimed:

1. A gas-blast electrical circuit breaker comprising:

a sealed casing filled with high dielectric strength insulating gas, notably sulphur hexafluoride, a pair of separable contacts having a stationary or semi-stationary contact, and a movable contact designed to be moved by an operating means between a closed position and an open position, a breaking gap with formation of an arc between the separated contacts, and a gas blast device capable of generating a gas outflow to the breaking gap to cool the arc by convection, wherein the gas-blast device comprises an insulating arc confinement wall, made of a material transparent or translucent to radiation of the arc.

2. The gas-blast electrical circuit breaker according to claim 1, wherein the material of said wall is a mineral insulating material, notably ceramic or glass-based.

3. The gas-blast electrical circuit breaker according to claim 1, wherein the material of said wall is a plastic insulating material, notably a polycarbonate or a polymethylmethacrylate.

4. The gas-blast electrical circuit breaker according to claim 1, having a puffer device comprising:

a piston-cylinder assembly operating in conjunction with the movable contact on opening to ensure compression of the gas by piston effect, a puffer nozzle coaxially surrounding the contacts during the arcing period to channel the gas outflow to the breaking gap, said transparent wall forming an integral part of the nozzle to enable the luminous radiations of the arc to propagate to the internal volume of the casing outside the nozzle.

5. The gas-blast electrical circuit breaker according to claim 4, wherein the puffer nozzle is manufactured by molding of the transparent plastic material.

6. The gas-blast electrical circuit breaker according to claim 4, wherein the puffer nozzle is made of a composite material, comprises an opaque convergent, notably made of alumina-loaded polytetrafluorethylene, the remainder comprising the neck and a divergent being made of a translucent insulating material.

7. The gas-blast electrical circuit breaker according to claim 1, wherein the gas-blast device comprises:

an internal enclosure disposed inside the casing and surrounding the breaking gap to confine an extinguishing chamber in which a gas pressure increase occurs due to the action of the arc, an expansion chamber formed by the remaining internal volume of the casing, outlets arranged inside the hollow contacts to make the extinguishing chamber communicate with the expansion chamber, the wall of said enclosure being totally or partially made of a transparent material.

8. The gas-blast electrical circuit breaker according to claim 7, wherein the extinguishing chamber in addition contains a coil or a permanent magnet associated with one of the contacts to make the arc rotate by the action of a magnetic field.

9. The gas-blast electrical circuit breaker according to claim 7, wherein the translucent enclosure presents a dissymmetric revolution profile shaped as a convergent or divergent optic lens to increase the radiation effect of the arc.

* * * * *